US012569777B1

(12) United States Patent
Wang

(10) Patent No.: US 12,569,777 B1
(45) Date of Patent: Mar. 10, 2026

(54) TOY COSMETIC BOX

(71) Applicant: Ruiqun Wang, Guangdong (CN)

(72) Inventor: Ruiqun Wang, Guangdong (CN)

( * ) Notice: Subject to any disclaimer, the term of this patent is extended or adjusted under 35 U.S.C. 154(b) by 0 days.

(21) Appl. No.: 19/265,134

(22) Filed: Jul. 10, 2025

(30) Foreign Application Priority Data

Jun. 27, 2025 (CN) ..... 202521353228.9

(51) Int. Cl.
*A63H 33/00* (2006.01)
*A45D 33/18* (2006.01)

(52) U.S. Cl.
CPC ..... *A63H 33/00* (2013.01); *A45D 33/18* (2013.01)

(58) Field of Classification Search
CPC ..... A63H 33/00; A45D 33/18; A45D 33/006; A45D 33/008; A45D 33/20; A45D 33/22; A45D 33/24
USPC ..... 446/71, 75, 76, 482, 487
See application file for complete search history.

(56) References Cited

U.S. PATENT DOCUMENTS 1,944,502 A * 1/1934 Factor ..... A45C 5/005 220/524
2,145,462 A * 1/1939 Speck ..... A45C 15/04 132/288
2,461,421 A * 2/1949 Jacobus ..... A45C 13/34 132/316
3,637,278 A * 1/1972 Easterbrooks ..... A45D 40/22 206/823
3,876,271 A * 4/1975 Skirlock ..... A45D 44/00 312/310
4,936,463 A * 6/1990 Tiramani ..... A45C 5/005 206/581
D325,123 S * 4/1992 Tiramani ..... D3/901
5,246,020 A * 9/1993 Wu ..... A45D 33/24 206/823
5,259,502 A * 11/1993 Chan ..... B25H 3/023 220/4.27
D361,430 S * 8/1995 Mohundro ..... D6/671.1
5,638,839 A * 6/1997 Montoli ..... A45D 40/22 220/255
5,941,255 A * 8/1999 Chen ..... A45D 29/20 206/823
6,129,237 A * 10/2000 Miyahara ..... G06F 1/1626 220/255
6,286,521 B1 * 9/2001 Joulia ..... A45D 40/221 132/295
6,595,609 B1 * 7/2003 Greiner ..... A47F 7/02 312/309
6,640,813 B2 * 11/2003 Raisner ..... A45C 11/008 132/200
6,986,355 B2 * 1/2006 Byun ..... A45D 33/006 132/294
7,040,486 B2 * 5/2006 Godshaw ..... A45C 7/0054 132/315

(Continued)

*Primary Examiner* — Joseph B Baldori

(57) ABSTRACT

A toy cosmetic box includes a base, a box body, and a support rod. The box body is disposed on the base. One end of the support rod is rotatably connected to the box body, and an opposite end of the support rod is rotatably connected to the base. The support rod is capable of driving the box body to move between a support position and a storage position. When the support rod is in the support position, the support rod supports the box body to be kept in an open state. When the support rod is in the storage position, the support rod is stored between the base and the box body.

17 Claims, 8 Drawing Sheets

(56) References Cited

U.S. PATENT DOCUMENTS

| | | | | |
|---|---|---|---|---|
| 7,107,084 | B2 * | 9/2006 | Duarte | G06F 1/1616 455/575.4 |
| 7,182,416 | B1 * | 2/2007 | Greiner | A47F 7/02 312/309 |
| 7,828,000 | B2 * | 11/2010 | Lee | A45D 40/22 132/304 |
| 7,849,863 | B2 * | 12/2010 | Corbellini | A45D 33/008 132/295 |
| 8,666,463 | B2 * | 3/2014 | Yoon | H04M 1/0235 340/487 |
| 9,289,047 | B2 * | 3/2016 | Limongi | A45D 33/008 |
| 9,480,322 | B2 * | 11/2016 | Mortis Simons | A45D 33/24 |
| 10,301,028 | B2 * | 5/2019 | Stephens | B64D 11/00152 |
| 12,121,132 | B2 * | 10/2024 | Hamze | A45D 40/24 |
| 2004/0200497 | A1 * | 10/2004 | Thorpe | A45D 33/008 132/287 |
| 2011/0088715 | A1 * | 4/2011 | Lee | A45C 11/16 132/316 |
| 2013/0284202 | A1 * | 10/2013 | Limongi | B65D 5/5213 132/316 |
| 2017/0265622 | A1 * | 9/2017 | Eberlein | A45D 40/22 |
| 2018/0116367 | A1 * | 5/2018 | Matsuura | A45D 42/02 |
| 2019/0365076 | A1 * | 12/2019 | Ducastin | A45D 33/008 |

* cited by examiner

TOY COSMETIC BOX

CROSS-REFERENCE TO RELATED APPLICATIONS

The application claims priority of Chinese patent application CN2025213532289, filed on Jun. 27, 2025, which is incorporated herein by reference in its entireties.

TECHNICAL FIELD

The present invention is applied in the field of children's toys, particularly relating to a toy cosmetic box.

BACKGROUND ART

Currently, toy cosmetic boxes, as common toys for children's simulated makeup games, are loved by many children. Existing toy cosmetic boxes typically include a box body and a cover body. An item receiving slot is defined in the box body for receiving cosmetics. The cover body is movably connected to the box body to open and close the item receiving slot. However, existing toy cosmetic boxes have the following technical problem.

When in use, existing toy cosmetic boxes usually can only maintain a fixed opening angle, lacking an angle adjustment function. This prevents flexible adjustment according to the user's height or habits, thereby affecting the user experience.

SUMMARY

To solve the problem mentioned in the above background art, the present invention provides a toy cosmetic box. By arranging a support rod with adjustable angle between the box body and the base, an angle-adjustable function is achieved, thereby meeting the requirements of different use scenarios.

The technical solution adopted by the present invention to solve its technical problems is as follows. A toy cosmetic box includes a base, a box body, and a support rod. One end of the support rod is rotatably connected to the box body, and an opposite end of the support rod is rotatably connected to the base. The support rod is capable of driving the box body to move between a support position and a storage position. When the support rod is in the support position, the support rod supports the box body to be kept in an open state. When the support rod is in the storage position, the support rod is stored between the base and the box body.

Beneficial effects of the present invention are as follows. By designing the two ends of the support rod to be rotatably connected to the box body and the base, the box body can be flexibly switched between the support position and the storage position, completely solving the problem of the inability to adjust the opening angle of existing toy cosmetic boxes due to structural fixation, meeting the viewing angle needs of children in different usage scenarios, and can also be adjusted according to the height of different children, with a stable structure.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
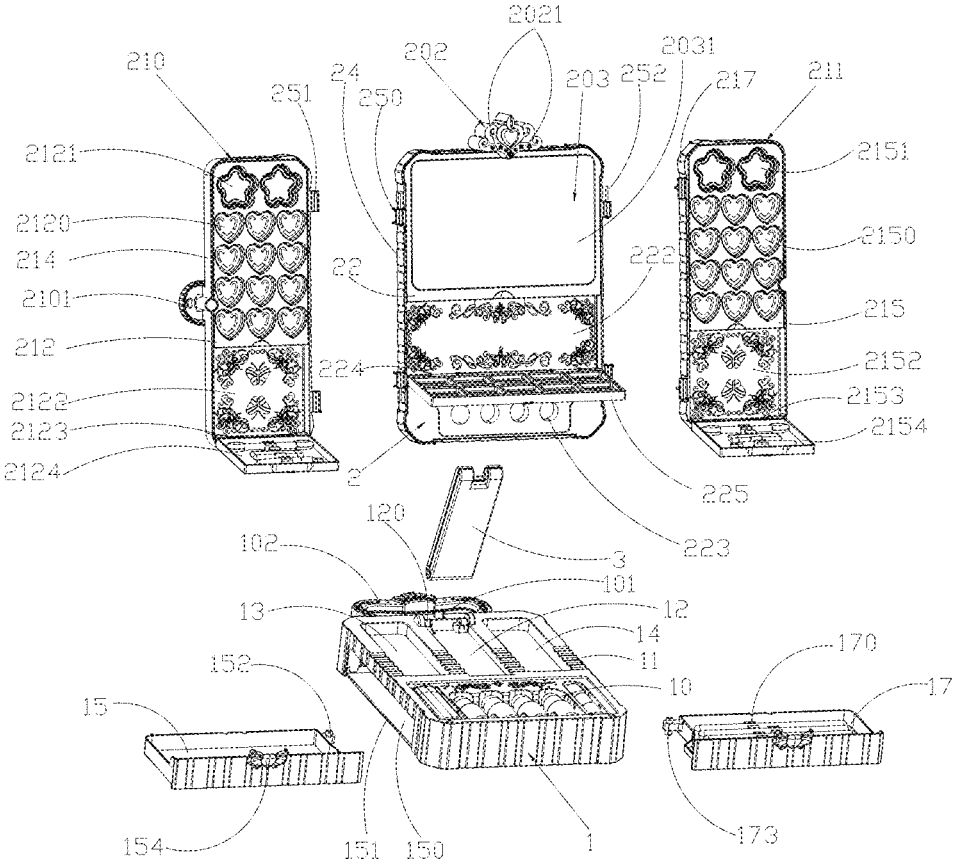
FIG. 1 is a schematic diagram of an exploded structure at a first angle according to the present invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Figure 2:
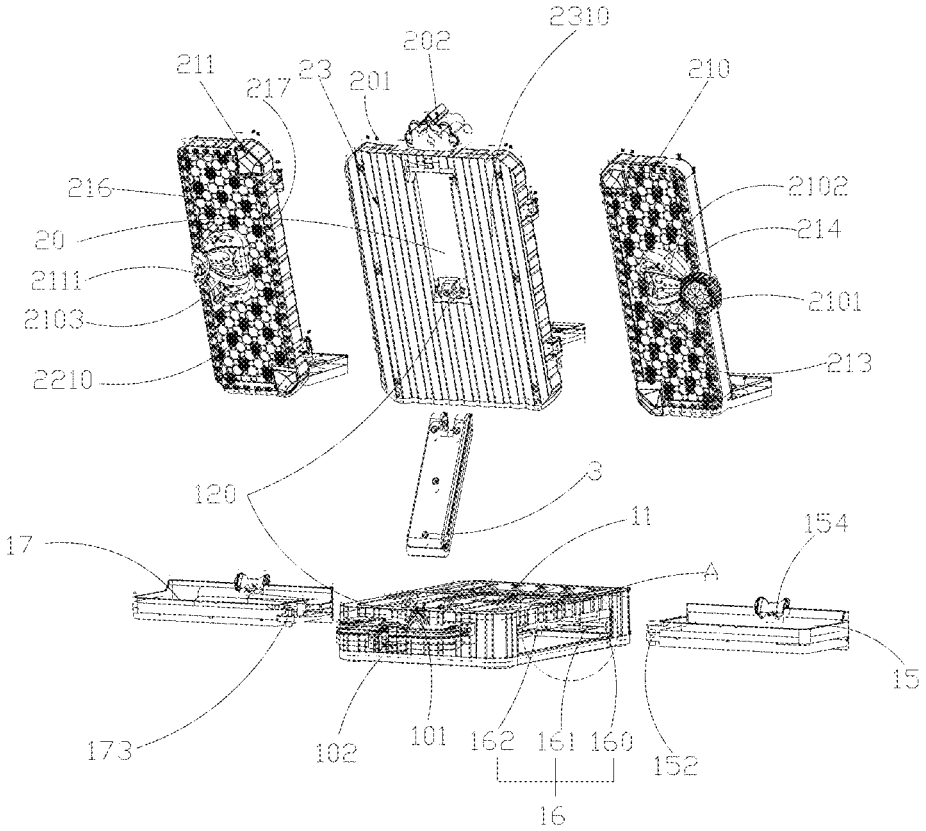
FIG. 2 is a schematic diagram of an exploded structure at a second angle according to the present invention.
Figure 3:
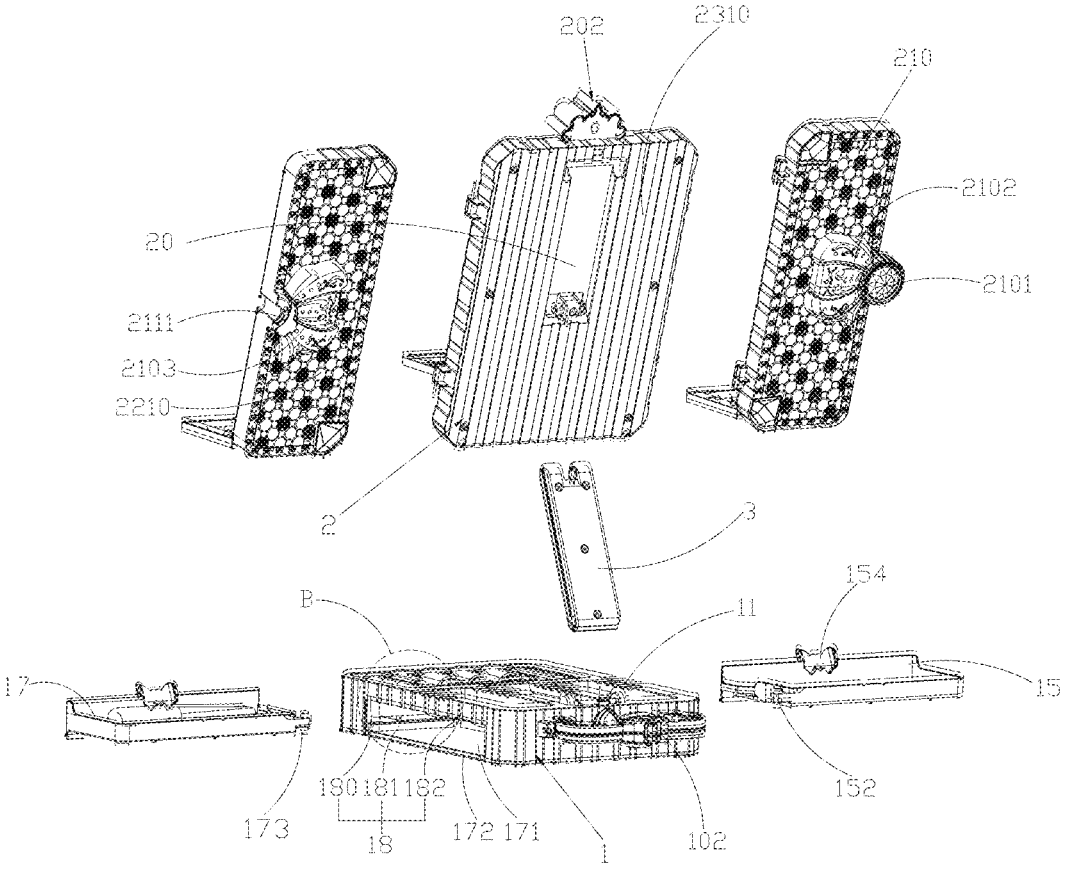
FIG. 3 is a schematic diagram of an exploded structure at a third angle according to the present invention.
Figure 4:
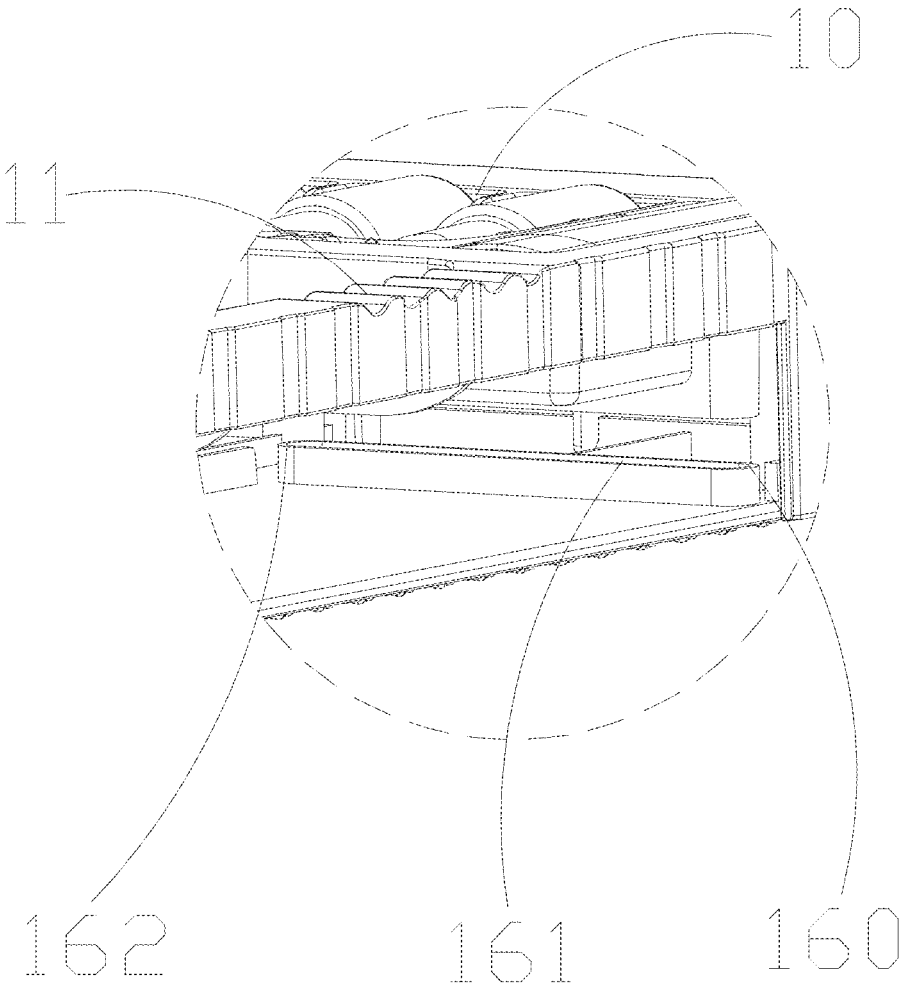
FIG. 4 is an enlarged view of area A of FIG. 2.
Figure 5:
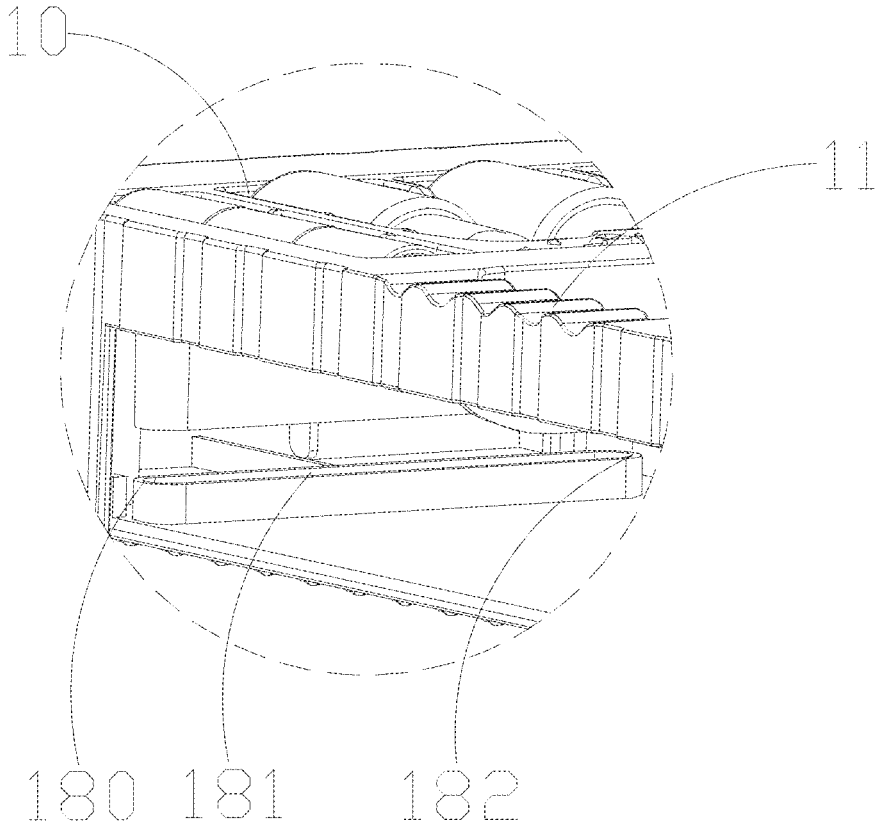
FIG. 5 is an enlarged view of area B of FIG. 3.
Figure 6:
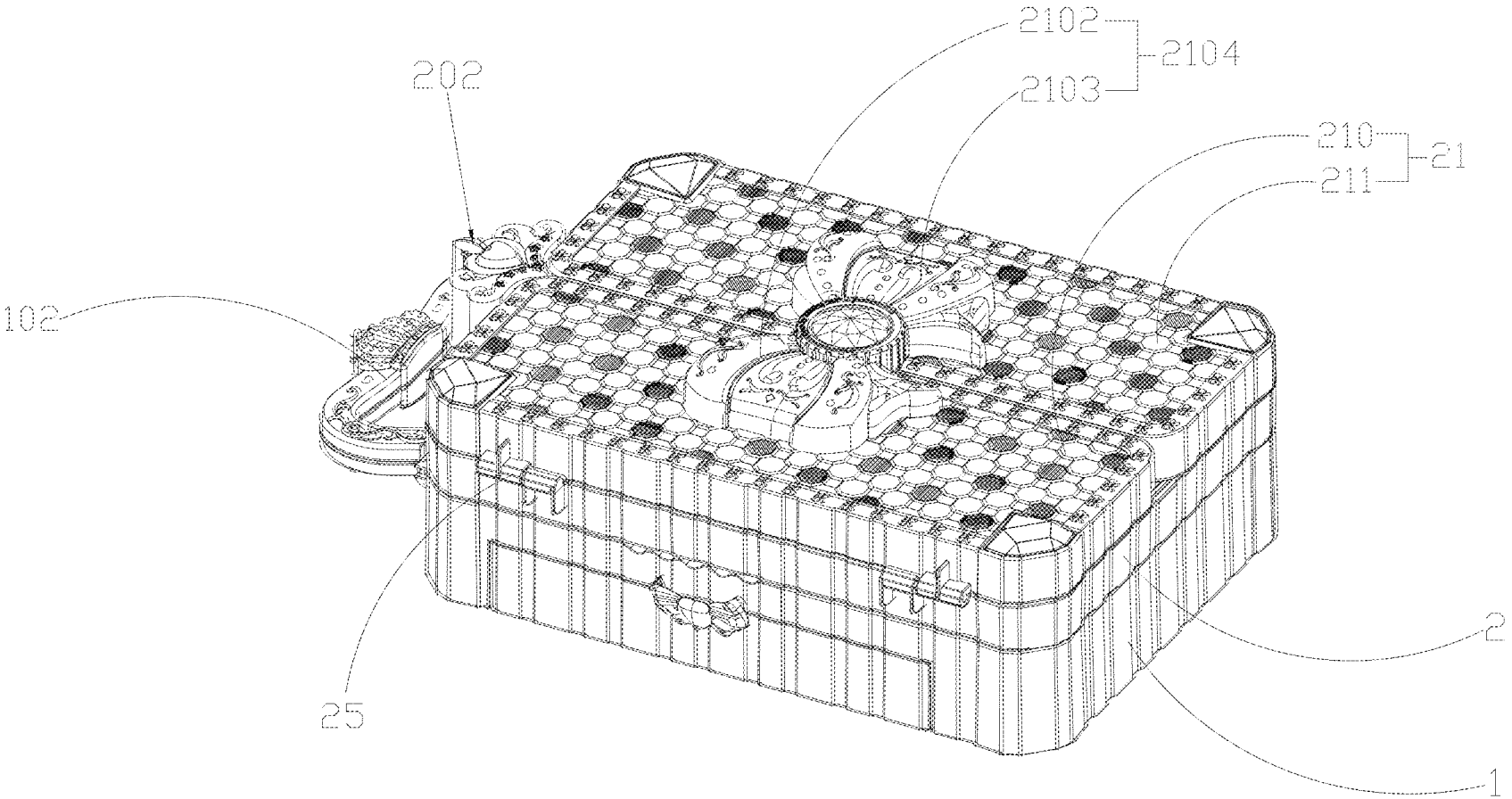
FIG. 6 is a schematic diagram of an overall structure of the present invention at a closed position.
Figure 7:
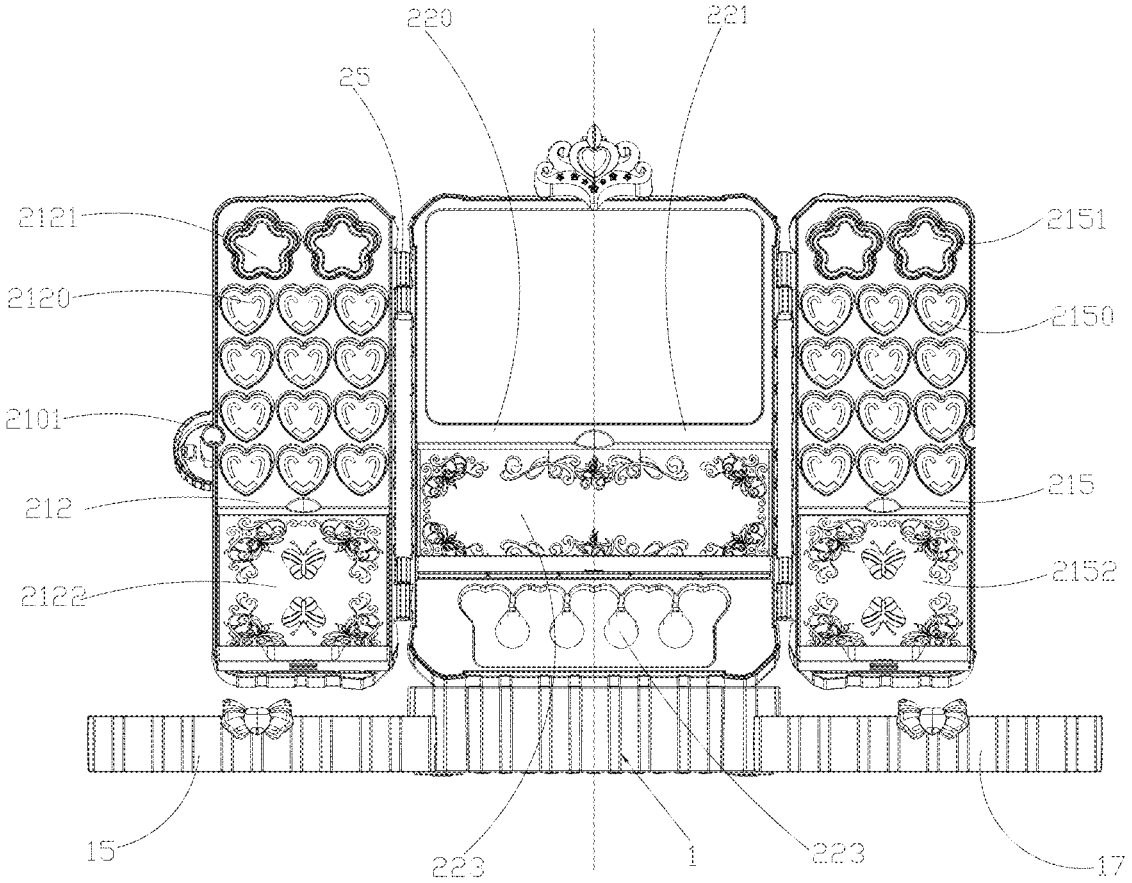
FIG. 7 is a schematic diagram of an overall structure of the present invention at an open position.
Figure 8:
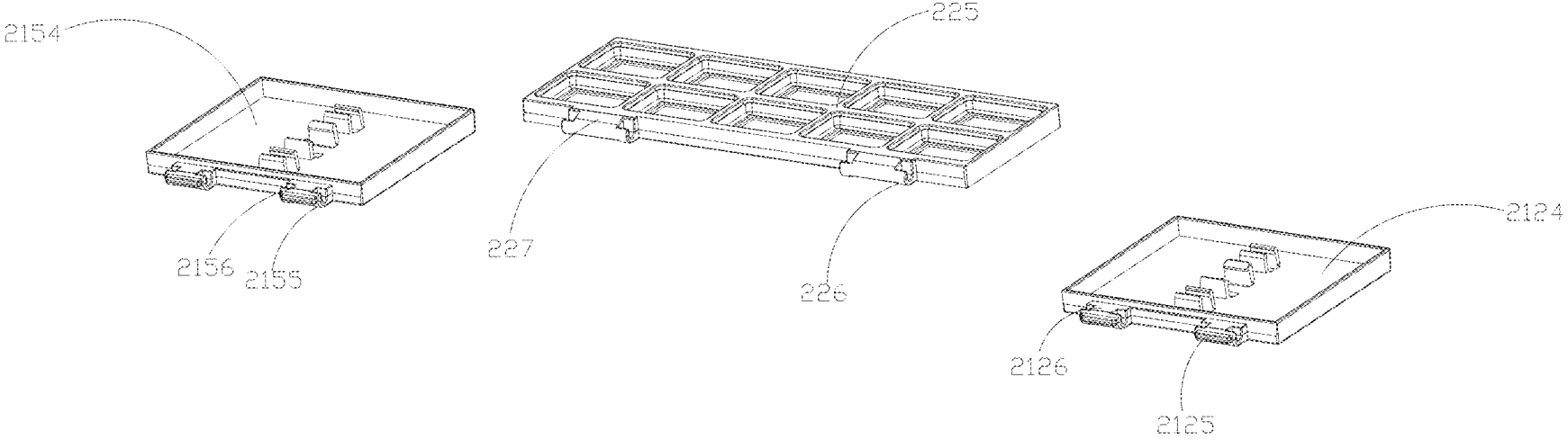
FIG. 8 is a schematic structural diagram of a first item storage plate, a second item storage plate, and a third item storage plate.

Referring to FIGS. 1-8, the present invention provides a toy cosmetic box. The toy cosmetic box includes a base 1, a box body 2, and a support rod 3. One end of the support rod 3 is rotatably connected to the box body 2, and an opposite end of the support rod 3 is rotatably connected to the base 1. The support rod 3 is capable of driving the box body 2 to move between a support position and a storage position. When the support rod 3 is in the support position, the support rod 3 supports the box body 2 to be kept in an open state. When the support rod 3 is in the storage position, the support rod 3 is stored between the base 1 and the box body 2.

Through the arrangement of the above structure, when the support rod 3 is positioned at the support position, the support rod 3 supports the box body 2 to be kept in the open state. When the support rod 3 is in the storage position, the support rod 3 is stored between the base 1 and the box body 2. Therefore, the support rod 3 is movable between the support position and the storage position to support or store the box body 2, allowing the box body 2 to adjust different opening states according to different usage environments, further enhancing the practicality of the toy cosmetic box.

In this embodiment, a plurality of item receiving slots 10 are defined in the base 1. The item receiving slots 10 are used for receiving items. When the box body 2 is in a closed state, the box body 2 is placed on the base 1 and covers the item receiving slots 10. When the box body 2 is in the open state, the box body 2 opens the item receiving slots 10. Through the arrangement of the above structure, an internal space of the base 1 is fully utilized, providing a user with rich storage areas that enable classification and storage of different types of cosmetics, thereby improving the storage capacity and convenience of the product. At the same time, the opening and closing function of the box body 2 effectively protects the items in the item receiving slots 10 from contamination.

In this embodiment, the base 1 is provided with a plurality of position limiting grooves 11. An end portion of the box body 2 is detachably engaged with one of the plurality of position limiting grooves 11. The plurality of position limiting grooves 11 are arranged in sequence along a length direction and a width direction of the base 1. Through the arrangement of the above structure, the design of the plurality of position limiting grooves 11 allows the box body 2 to choose different installation positions according to usage needs, achieving multi-angle positioning of the box body 2 relative to the base 1, enhancing the flexibility and adaptability of product use.

In this embodiment, the base 1 is further provided with a first storage slot 12. The support rod 3 is capable of being stored in the first storage slot 12. Through the arrangement of the above structure, the first storage slot 12 provides a dedicated storage space for the support rod 3. When the support rod 3 is not in use, the support rod 3 can be completely hidden inside the base 1, avoiding the exposure of the support rod 3 and affecting the overall aesthetics of the product, while also preventing damage to the support rod 3.

In this embodiment, the base 1 is further provided with a second storage slot 13 and a third storage slot 14. The first storage slot 12 is positioned between the second storage slot 13 and the third storage slot 14. The second storage slot 13 and the third storage slot 14 are used for storing items. Through the arrangement of the above structure, the addition of the second storage slot 13 and the third storage slot 14 further expands the storage function of the base 1, and the reasonable layout of the three storage slots achieves the maximum utilization of storage space.

In this embodiment, the base 1 further includes a first storage box 15, a first accommodating cavity 150, and a first accommodating opening 151. The first storage box 15 is rotatably connected to the base 1, so that the first storage box 15 is movable between a storage position and an unfolded position. The first accommodating cavity 150 is in communication with the first accommodating opening 151. When the first storage box 15 is in the storage position, the first storage box 15 is positioned in the first accommodating cavity 150. When the first storage box 15 is in the unfolded position, the first storage box 15 extends out of the first accommodating opening 151. Through the arrangement of the above structure, the extendable and retractable design of the first storage box 15 greatly increases the storage flexibility of the product. When not in use, the first storage box 15 can be completely hidden inside the base 1 to maintain the compactness of the product. When needed, the first storage box 15 can be quickly unfolded to provide additional storage space, effectively improving the space utilization and usability of the product.

In this embodiment, the box body 2 is further provided with a fourth storage slot 20. The fourth storage slot 20 is defined in a bottom portion of the box body 2. When the box body 2 is in the closed state, a part of the support rod 3 is stored in the first storage slot 12, and an opposite part of the support rod 3 is stored in the fourth storage slot 20. Through the arrangement of the above structure, the coordinated design of the fourth storage slot 20 and the first storage slot 12 achieves complete storage of the support rod 3, ensuring the concealment of the support rod 3 in the storage state, thereby enhancing the aesthetic appearance of the product in the storage state.

In this embodiment, the toy cosmetic box further includes mounting seats 120. The mounting seats 120 are positioned in the first storage slot 12 and the fourth storage slot 20 respectively, and two ends of the support rod 3 are respectively movably connected to the mounting seats 120. Through the arrangement of the above structure, the mounting seats 120 provide rotational support points for the support rod 3, ensuring the stability and smoothness of the support rod 3 during rotation. At the same time, the design of the movable connection allows the support rod 3 to be flexibly adjusted between different angles.

In this embodiment, the base 1 further includes a first sliding slot 16. The first storage box 15 is provided with a first sliding structure 152 extending along a side wall of the first storage box 15. The first sliding structure 152 is slidably engaged with the first sliding slot 16. The first sliding structure 152 is slidable inside the first sliding slot 16. The first sliding structure 152 is also rotatable inside the first sliding slot 16 and drives the first storage box 15. Through the arrangement of the above structure, when the first storage box 15 moves from the unfolded position to the storage position, the first sliding structure 152 drives the first storage box 15 to rotate to a position parallel to the first accommodating opening 151 under an external force. Then, under a pushing force, the first sliding structure 152 is capable of driving the first storage box 15 to slide along the first sliding slot 16 into the first accommodating cavity 150. The first sliding slot 16 may be one or two, and in the present application, two sliding slots are preferred. The first sliding structure 152 is positioned between the two sliding slots, thereby allowing the first storage box 15 to slide and rotate better.

In this embodiment, the first sliding slot 16 includes a first position limiting portion 160, a first sliding track 161, and a second position limiting portion 162. The first position limiting portion 160 is positioned at one end of the first sliding track 161, and the second position limiting portion 162 is positioned at an opposite end of the first sliding track 161. The first sliding structure 152 is adapted to the first sliding track 161. When the first sliding structure 152 slides along the first sliding track 161 to the first position limiting portion 160, the first sliding structure 152 is rotatable along the first sliding track 161. Through the arrangement of the above structure, the first position limiting portion 160 and the second position limiting portion 162 serve as stop parts for the first sliding structure 152, ensuring that the user can accurately position the first storage box 15 during sliding. At the same time, the design of the position limiting portions also prevents excessive movement of the first sliding structure 152.

In this embodiment, the base 1 is further equipped with a second storage box 17. The first storage box 15 is positioned on one side of the base 1, and the second storage box 17 is positioned on an opposite side of the base 1. A clamping slot 170 is defined in the second storage box 17. The clamping slot 170 is used for clamping an item. Through the arrangement of the above structure, the symmetrical layout of the second storage box 17 and the first storage box 15 achieves a balanced distribution of storage functions on both sides of the base 1. The specially designed clamping slot 170 provides a stable clamping function for a cosmetic brush, an eyebrow pencil, etc., avoiding the sliding of items during storage.

In this embodiment, the base 1 is further provided with a second accommodating cavity 171 and a second accommodating opening 172. The second accommodating box 17 is rotatably connected to the base 1, so that the second accommodating box 17 is movable between the storage position and the unfolded position. The second accommodating cavity 171 is in communication with the second accommodating opening 172. When the second storage box 17 is in the storage position, the second storage box 17 is positioned in the second accommodating cavity 171. When the second storage box 17 is in the unfolded position, the second storage box 17 extends out of the second accommodating opening 172, and the first storage box 15 and the second storage box 17 are on an identical horizontal line. Through the arrangement of the above structure, the synchronous design of the second storage box 17 and the first storage box 15 achieves coordinated and unified storage functions on both sides of the base 1. The symmetrical layout formed when the two storage boxes are unfolded simultaneously is not only beautiful but also provides greater operating space, making it easy for the user to access different types of cosmetics at the same time.

In this embodiment, the base 1 further includes a second sliding slot 18. The second sliding slot 18 includes a third position limiting portion 180, a second sliding track 181, and a fourth position limiting portion 182. The third position limiting portion 180 is positioned at one end of the second sliding track 181, and the fourth position limiting portion 182 is positioned at an opposite end of the second sliding track 181. The second storage box 17 is provided with a second sliding structure 173 extending along a side wall of the second storage box 17. The second sliding structure 173 is adapted to the second sliding track 181. When the second sliding structure 173 slides along the second sliding track 181 to the third position limiting portion 180, the second sliding structure 173 is capable of driving the second storage box 17 to rotate. When the second sliding structure 173 slides along the second sliding track 181 to the fourth position limiting portion 182, the second storage box 17 is positioned inside the second accommodating cavity 171. Through the arrangement of the above structure, similarly, the second sliding slots 18 in the present application are preferably two. The symmetrical design of the second sliding slot 18 and the first sliding slot 16 ensures that the two storage boxes have identical operating feel and functional performance. The precise control of the position limiting portions ensures the accurate positioning of the second storage box 17 in various positions, improving the consistency and reliability of product operation.

In this embodiment, the box body 2 is equipped with a cover body 21. The cover body 21 is movably connected to the box body 2, so that the cover body 21 is movable between a closed position and an open position. Through the arrangement of the above structure, the design of the cover body 21 provides effective protection for the storage space inside the box body 2, preventing dust from entering and items from scattering in the closed state, and making it convenient for the user to access the internal items in the open state.

In this embodiment, the box body 2 includes an upper housing 22, a lower housing 23, and a side housing 24. The cover body 21 includes a first cover body 210 and a second cover body 211. The first cover body 210 is connected to one side of the upper housing 22, and the second cover body 211 is connected to an opposite side of the upper housing 22. The upper housing 22 includes a first part 220 and a second part 221. When in the closed position, the first cover body 210 covers the first part 220, and the second cover body 211 covers the second part 221. When in the open position, the first cover body 210 opens the first part 220, and the second cover body 211 opens the second part 221. Through the arrangement of the above structure, the split-type design of the cover body realizes the zoned management of an internal space of the box body 2. The user can selectively open the cover body on one side according to a need without fully opening, which improves the convenience of use and reduces unnecessary space exposure.

In this embodiment, the toy cosmetic box further includes a connecting member 25. The first cover body 210 is connected to one side of the box body 2 through the connecting member 25, and the second cover body 211 is connected to an opposite side of the box body 2 through the connecting member 25. Through the arrangement of the above structure, the connecting member 25 provides a stable and reliable connection method for the first cover body 210 and the second cover body 211, ensuring stability during use.

In this embodiment, the connecting member 25 includes a hinge seat 250, a hinge sleeve 251, and a hinge shaft 252. The hinge seat 250 is fixedly connected to the box body 2. The hinge sleeve 251 is fixedly connected to the first cover body 210 and the second cover body 211, and corresponds to the hinge seat 250. One part of the hinge shaft 252 is connected within the hinge seat 250, and an opposite part of the hinge shaft 252 is connected within the hinge sleeve 251, so that the first cover body 210 and the second cover body 211 are rotatable around the hinge shaft 252, respectively. Through the arrangement of the above structure, the hinge structure provides a smooth and stable rotation function for the cover body, while the coordinated design of the hinge seat 250 and the hinge sleeve 251 ensures the firmness of the connection.

In this embodiment, the first cover body 210 further includes a first upper side wall 212, a first lower side wall 213, and a first connecting side wall 214. The first connecting side wall 214 is connected to the first upper side wall 212 and the first lower side wall 213. When the first cover body 210 is in the closed position, the first upper side wall 212 covers the first part 220. Through the arrangement of the above structure, the covering function of the first upper side wall 212 effectively protects the items inside the first part 220, improving the protective performance of the product.

In this embodiment, the second cover body 211 further includes a second upper side wall 215, a second lower side wall 216, and a second connecting side wall 217. The second connecting side wall 217 is connected to the second upper side wall 215 and the second lower side wall 216. When both the first cover body 210 and the second cover body 211 are in the closed position, the first upper side wall 212 covers the first part 220, and the second upper side wall 215 covers the second part 221. Through the arrangement of the above structure, the symmetrical structural design of the second cover body 211 and the first cover body 210 ensures the complete sealing of the entire box body 2, and the coordinated cooperation of the two cover bodies forms a unified appearance and functional performance.

In this embodiment, the first upper side wall 212 includes a plurality of first cosmetic slots 2120 and a plurality of second cosmetic slots 2121. The first cosmetic slots 2120 and the second cosmetic slots 2121 are different in shape. The plurality of first cosmetic slots 2120 are arranged in sequence along a length direction and a width direction of the first upper side wall 212. The second cosmetic slots 2121 are arranged in sequence along the width direction of the first upper side wall 212, and the second cosmetic slots 2121 are positioned on one side of the first cosmetic slots 2120. Through the arrangement of the above structure, the first cosmetic slots 2120 are heart-shaped, and the second cosmetic slots 2121 are petal-shaped. The design of cosmetic slots with different shapes and sizes realizes the storage of various cosmetic products. The reasonable layout of the first cosmetic slots 2120 and the second cosmetic slots 2121 maximizes the space utilization of the first upper side wall 212, providing the user with the convenience of classified storage.

In this embodiment, the first upper side wall 212 further includes a first groove 2122, a first rotating structure 2123, and a first item storage plate 2124. The first item storage plate 2124 includes a first stop surface 2125 and a first fitting surface 2126. The first item storage plate 2124 is movably connected to the first groove 2122 through the first rotating structure 2123. The first item storage plate 2124 is movable between an unfolded position and a storage position. The first item storage plate 2124 rotates out of the first groove 2122. When the first stop surface 2125 abuts against a side surface of the first groove 2122, the first item storage plate 2124 is positioned in the unfolded position. When the first fitting surface 2126 abuts against a bottom surface of the first groove 2122, the first item storage plate 2124 is positioned in the storage position. Through the arrangement of the above structure, the first stop surface 2125 can make a rotation angle of the first item storage plate 2124 be 90 degrees. A surface of the first groove 2122 is also decorated with butterflies and flowers, providing the user with better visual enjoyment. When the first item storage plate 2124 is in the unfolded position, the first item storage plate 2124 can be used as a temporary storage table surface. When the first item storage plate 2124 is in the storage position, the first item storage plate 2124 fits perfectly with the first groove 2122 without affecting the overall appearance.

In this embodiment, the upper housing 22 is provided with a second groove 222, a third groove 223, a second rotating structure 224, and a second item storage plate 225. The second item storage plate 225 includes a second stop surface 226 and a second fitting surface 227. The second item storage plate 225 is movably connected to the second groove 222 through the second rotating structure 224. The second item storage plate 225 is movable between an unfolded position and a storage position. The second item storage plate 225 rotates out of the second groove 222. When the second stop surface 226 abuts against a side surface of the second groove 222, the second item storage plate 225 is in the unfolded position. When the second fitting surface 227 abuts against a bottom surface of the second groove 222, the second item storage plate 225 is in the storage position. Through the arrangement of the above structure, the second stop surface 226 can make a rotation angle of the second item storage plate 225 be 90 degrees. A surface of the second groove 222 is further provided with a decorative pattern of flowers, which brings better visual enjoyment to the user. The arrangement of the second item storage plate 225 on the upper housing 22 provides the user with an additional operation table surface, and the adjustable characteristics allow the user to flexibly configure the spatial layout according to an actual need.

In this embodiment, the second upper side wall 215 includes a plurality of third cosmetic slots 2150 and a plurality of fourth cosmetic slots 2151. The third cosmetic slots 2150 and the fourth cosmetic slots 2151 are different in shape. The plurality of third cosmetic slots 2150 are arranged in sequence along a length direction and a width direction of the second upper side wall 215. The fourth cosmetic slots 2151 are arranged in sequence along the width direction of the second upper side wall 215. The fourth cosmetic slots 2151 are positioned on one side of the third cosmetic slots 2150. Through the arrangement of the above structure, similarly, the third cosmetic slots 2150 are heart-shaped, and the fourth cosmetic slots 2151 are petal-shaped. The design of the third cosmetic slots 2150 and the fourth cosmetic slots 2151 increases the storage space for cosmetic items and achieves a balanced distribution of functions on both sides.

In this embodiment, the second upper side wall 215 further includes a fourth groove 2152, a third rotating structure 2153, and a third item storage plate 2154. The third item storage plate 2154 includes a third stop surface 2155 and a third fitting surface 2156. The third item storage plate 2154 is movably connected to the fourth groove 2152 through the third rotating structure 2153. The third item storage plate 2154 is movable between an unfolded position and a storage position. The third item storage plate 2154 rotates out of the fourth groove 2152. When the third stop surface 2155 abuts against a side surface of the fourth groove 2152, the third item storage plate 2154 is in the unfolded position. When the third fitting surface 2154 abuts against a bottom surface of the fourth groove 2152, the third item storage plate 2154 is in the storage position. Through the arrangement of the above structure, the third stop surface 2155 can make a rotation angle of the third item storage plate 2154 be 90 degrees. The symmetrical configuration of the third item storage plate 2154 and the first item storage plate 2124 achieves a balanced distribution of functions on both sides, providing the user with more operating space options.

In this embodiment, the first cover body 210 is provided with a rotating buckle 2101. The second cover body 211 is provided with an engaging slot 2111. When both the first cover body 210 and the second cover body 211 are in the closed position, the rotating buckle 2101 is movable between a locking state and an unlocking state. When the rotating buckle 2101 moves into the engaging slot 2111, the rotating buckle 2101 is in the locking state. When the rotating buckle 2101 disengages from the engaging slot 2111, the rotating buckle 2101 is in the unlocking state, so that the first cover body 210 and the second cover body 211 are movable from the closed position to the open position. Through the arrangement of the above structure, the coordinated design of the rotating buckle 2101 and the engaging slot 2111 provides reliable locking function for the two cover bodies, preventing accidental opening of the cover bodies during transportation or movement. At the same time, the design of the rotating operation makes the locking and unlocking process simple and convenient.

In this embodiment, the first cover body 210 is further provided with a first ornament 2102, and the second cover body 211 is further provided with a second ornament 2103. When the first cover body 210 covers the first part 220 and the second cover body 211 covers the second part 221, the first ornament 2102 and the second ornament 2103 are combined to form a first pattern 2104. Through the arrangement of the above structure, the creative design of the split-type ornament not only enhances the visual aesthetics of the product, but also increases the fun and interactivity of the product. The complete pattern formed when the two cover bodies are completely closed brings visual pleasure to the user.

In this embodiment, the box body 2 further includes a decorative mirror 203 and a decorative mirror mounting slot 2031. The decorative mirror 203 is fixedly arranged on the decorative mirror mounting slot 2031. Through the arrangement of the above structure, the configuration of the decorative mirror 203 greatly enhances the practicality of the toy cosmetic box. A thickness of the decorative mirror 203 is less than or equal to a depth of the decorative mirror mounting slot 2031, which improves the service life of the decorative mirror 203.

In this embodiment, the rotating buckle 2101 is provided with anti-slip patterns. Through the arrangement of the above structure, the design of the anti-slip patterns improves a finger grip force when the user operates the rotating buckle 2101, preventing slippage during the operation.

In this embodiment, the base 1 is provided with a locking block 101. The box body 2 is provided with a locking slot 201. When the box body 2 covers the base 1, the locking block 101 is capable of being engaged in the locking slot 201 to allow the box body 2 to be detachably fixed to the base 1. Through the arrangement of the above structure, the engaging structure of the locking block 101 and the locking slot 201 provides a stable and reliable connection between the box body 2 and the base 1, ensuring stability during use and facilitating disassembly and reassembly by the user as needed.

In this embodiment, the box body 2 is further provided with a positioning member 202, and positioning slots 2021 are respectively defined in both sides of the positioning member 202. When in the closed position, a corner of the first cover body 210 and a corner of the second cover body 211 are respectively positioned in the positioning slots 2021. Through the arrangement of the above structure, the coordinated design of the positioning member 202 and the positioning slots 2021 ensures precise alignment of the two cover bodies in the closed state, enhancing the aesthetic appeal of the product.

In this embodiment, the base 1 is further equipped with a handle 102. The handle 102 is movably connected to a side wall of the base 1. Through the arrangement of the above structure, the design of the handle 102 greatly enhances the portability of the product, facilitating hand-carrying and movement by the user.

In this embodiment, the first storage box 15 is also equipped with a pull grip 154. The pull grip 154 is fixedly connected to a side wall edge near the first storage box 15. When the first storage box 15 is in the storage position, a part of the pull grip 154 abuts against a side wall of the base 1 to restrict further sliding of the first storage box 15. Through the arrangement of the above structure, the pull grip 154 not only provides a convenient grip point for the user to operate the first storage box 15, but also plays a precise position limiting role, ensuring the accurate positioning of the first storage box 15 in the storage position.

In this embodiment, the first lower side wall 213, the second lower side wall 216, and a lower surface of the base 1 are all provided with first decorative patterns 2210. The lower housing 23, the side housing 24, and a side surface of the base 1 are all provided with second decorative patterns 2310. The first decorative patterns 2210 and the second decorative patterns 2310 are different in shape. Through the arrangement of the above structure, the design of using different decorative patterns in different positions not only enhances the visual hierarchy and aesthetics of the product, but also provides the user with a better tactile experience and anti-slip effect.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A toy cosmetic box, comprising:

a base;

a box body; and a support rod;

wherein the box body is disposed on the base; one end of the support rod is rotatably connected to the box body; an opposite end of the support rod is rotatably connected to the base; the support rod is capable of driving the box body to move between a support position and a storage position; when the support rod is in the support position, the support rod supports the box body to be kept in an open state; and when the support rod is in the storage position, the support rod is stored between the base and the box body;

wherein the base further comprises a first storage box, a first accommodating cavity, and a first accommodating opening; the first storage box is rotatably connected to the base, so that the first storage box is movable between a storage position and an unfolded position; the first accommodating cavity is in communication with the first accommodating opening; when the first storage box is in the storage position, the first storage box is positioned in the first accommodating cavity; and when the first storage box is in the unfolded position, the first storage box extends out of the first accommodating opening;

wherein the base further comprises a first sliding slot; the first storage box is provided with a first sliding structure extending along a side wall of the first storage box; the first sliding structure is slidably engaged with the first sliding slot; the first sliding structure is slidable inside the first sliding slot; and the first sliding structure is also rotatable inside the first sliding slot and drives the first storage box.

2. The toy cosmetic box according to claim 1, wherein a plurality of item receiving slots are defined in the base; the item receiving slots are used for receiving items; when the box body is in a closed state, the box body is placed on the base and covers the item receiving slots; and when the box body is in the open state, the box body opens the item receiving slots.

3. The toy cosmetic box according to claim 2, wherein the base is provided with a plurality of position limiting grooves; an end portion of the box body is detachably engaged with one of the plurality of position limiting grooves; and the plurality of position limiting grooves are arranged in sequence along a length direction and a width direction of the base.

4. The toy cosmetic box according to claim 1, wherein the base is further provided with a first storage slot; and the support rod is capable of being stored in the first storage slot.

5. The toy cosmetic box according to claim 4, wherein the base is further provided with a second storage slot and a third storage slot; the first storage slot is positioned between the second storage slot and the third storage slot; and the second storage slot and the third storage slot are used for storing items.

6. The toy cosmetic box according to claim 1, wherein the first sliding slot comprises a first position limiting portion, a first sliding track, and a second position limiting portion; the first position limiting portion is positioned at one end of the first sliding track; the second position limiting portion is positioned at an opposite end of the first sliding track; the first sliding structure is adapted to the first sliding track; and when the first sliding structure slides along the first sliding track to the first position limiting portion, the first sliding structure is rotatable along the first sliding track.

7. The toy cosmetic box according to claim 1, wherein the base is further equipped with a second storage box; the first storage box is positioned on one side of the base; the second storage box is positioned on an opposite side of the base; a clamping slot is defined in the second storage box; and the clamping slot is used for clamping an item.

8. The toy cosmetic box according to claim 1, further comprising a connecting member, wherein the first cover body is connected to one side of the upper housing through the connecting member; and the second cover body is connected to an opposite side of the upper housing through the connecting member.

9. The toy cosmetic box according to claim 8, wherein the first cover body further comprises a first upper side wall, a first lower side wall, and a first connecting side wall; the first connecting side wall is connected to the first upper side wall and the first lower side wall; and when the first cover body is in the closed position, the first upper side wall covers the first part.

10. The toy cosmetic box according to claim 9, wherein the first upper side wall comprises a plurality of first cosmetic slots and a plurality of second cosmetic slots; the first cosmetic slots and the second cosmetic slots are different in shape; the plurality of first cosmetic slots are arranged in sequence along a length direction and a width direction of the first upper side wall; the second cosmetic slots are arranged in sequence along the width direction of the first upper side wall; and the second cosmetic slots are positioned on one side of the first cosmetic slots.

11. The toy cosmetic box according to claim 10, wherein the first upper side wall further comprises a first groove, a first rotating structure, and a first item storage plate; the first item storage plate comprises a first stop surface and a first fitting surface; the first item storage plate is movably connected to the first groove through the first rotating structure; the first item storage plate is movable between an unfolded position and a storage position; the first item storage plate rotates out of the first groove; when the first stop surface abuts against a side surface of the first groove, the first item storage plate is positioned in the unfolded position; and when the first fitting surface abuts against a bottom surface of the first groove, the first item storage plate is positioned in the storage position.

12. The toy cosmetic box according to claim 11, wherein the upper housing is provided with a second groove, a third groove, a second rotating structure, and a second item storage plate; the second item storage plate comprises a second stop surface and a second fitting surface; the second item storage plate is movably connected to the second groove through the second rotating structure; the second item storage plate is movable between an unfolded position and a storage position; the second item storage plate rotates out of the second groove; when the second stop surface abuts against a side surface of the second groove, the second item storage plate is in the unfolded position; and when the second fitting surface abuts against a bottom surface of the second groove, the second item storage plate is in the storage position.

13. The toy cosmetic box according to claim 10, wherein the first cover body is provided with a rotating buckle; the second cover body is provided with an engaging slot; when both the first cover body and the second cover body are in the closed position, the rotating buckle is movable between a locking state and an unlocking state; when the rotating buckle moves into the engaging slot, the rotating buckle is in the locking state; and when the rotating buckle disengages from the engaging slot, the rotating buckle is in the unlocking state, so that the first cover body and the second cover body are movable from the closed position to the open position.

14. The toy cosmetic box according to claim 1, wherein the first cover body is further provided with a first ornament; the second cover body is further provided with a second ornament; when the first cover body covers the first part and the second cover body covers the second part, the first ornament and the second ornament are combined to form a first pattern.

15. The toy cosmetic box according to claim 1, wherein the box body further comprises a decorative mirror and a decorative mirror mounting slot; and the decorative mirror is fixedly arranged on the decorative mirror mounting slot.

16. The toy cosmetic box according to claim 1, wherein the base is provided with a locking block; the box body is provided with a locking slot; and when the box body covers the base, the locking block is capable of being engaged in the locking slot to allow the box body to be detachably fixed to the base.

17. A toy cosmetic box, comprising:

a base;

a box body; and a support rod;

wherein the box body is disposed on the base; one end of the support rod is rotatably connected to the box body; an opposite end of the support rod is rotatably connected to the base; the support rod is capable of driving the box body to move between a support position and a storage position; when the support rod is in the support position, the support rod supports the box body to be kept in an open state; and when the support rod is in the storage position, the support rod is stored between the base and the box body;

wherein the box body is equipped with a cover body; and the cover body is movably connected to the box body, so that the cover body is movable between a closed position and an open position;

wherein the box body comprises an upper housing, a lower housing, and a side housing; the cover body comprises a first cover body and a second cover body; the first cover body is connected to one side of the upper housing; the second cover body is connected to an opposite side of the upper housing; the upper housing comprises a first part and a second part; when in the closed position, the first cover body covers the first part, and the second cover body covers the second part; when in the open position, the first cover body opens the first part, and the second cover body opens the second part.

* * * * *